US005803337A

United States Patent [19]

Fukai et al.

[11] Patent Number: 5,803,337

[45] Date of Patent: Sep. 8, 1998

[54] ELECTRIC STAPLER

[75] Inventors: Shigeki Fukai, Tokyo; Naoto Mochizuki, Yamanashi-ken, both of Japan

[73] Assignee: Riso Kagaku Corporation, Tokyo, Japan

[21] Appl. No.: 855,390

[22] Filed: May 13, 1997

[30] Foreign Application Priority Data

May 13, 1996 [JP] Japan ..... 8-117515

[51] Int. Cl.[6] ..... B27F 7/36

[52] U.S. Cl. ..... 227/7; 227/131

[58] Field of Search ..... 227/2, 5, 6, 7, 227/131

[56] References Cited

U.S. PATENT DOCUMENTS

| | | | |
|---|---|---|---|
| 4,795,071 | 1/1989 | Jacobs et al. | 227/7 |
| 5,427,296 | 6/1995 | Chen | 227/7 |
| 5,595,336 | 1/1997 | Everdyke | 227/7 |
| 5,657,918 | 8/1997 | Shimomura et al. | 227/7 |

*Primary Examiner*—Scott A. Smith
*Attorney, Agent, or Firm*—Sixbey, Friedman, Leedom & Ferguson, P.C.; Gerald J. Ferguson, Jr.

[57] ABSTRACT

An electric stapler has a stapling mechanism which is connected to a power source through a switch and staples a sheet stack inserted into a throat. An actuator is adapted to abut against an edge of a sheet stack at a plurality of positions along the edge of the sheet stack and to be moved by the sheet stack in response to insertion thereof to an operative position where it operates the switch to actuate the stapling mechanism. A sub-actuator is positioned in front of the actuator and is movable between an erected position where it stands into the sheet stack insertion passage to abut against a sheet stack when the sheet stack is inserted into the throat and a horizontal position where it is retracted from the sheet stack insertion passage not to abut against a sheet stack. The sub-actuator is adapted to abut against a pair of adjacent edges of a sheet stack forming a corner of the sheet stack when it is in the erected position and is movable to drive the actuator to the operative position pushed by the sheet stack as the sheet stack is further inserted into the throat.

2 Claims, 4 Drawing Sheets

ELECTRIC STAPLER

BACKGROUND OF THE INVENTION

1. Field of the Invention

This invention relates to an electric stapler for stapling a sheet stack, and more particularly to an electric stapler which can staple a sheet stack so that the staple is positioned in a corner of the sheet at an angle to adjacent edges of the sheet stack (will be referred to as "slantwise stapling" hereinbelow) as well as so that the staple is positioned in parallel to an edge of the sheet stack (will be referred to as "parallel stapling" hereinbelow).

2. Description of the Related Art

There has been known an electric stapler which is provided with a stapling mechanism in the back of a throat or a slot and an actuator which is brought into contact with an edge of a sheet stack at two parts of the edge as the sheet stack is inserted into the throat and is moved inward pushed by the edge of the sheet stack to actuate the stapling mechanism, thereby effecting parallel stapling of the sheet stack.

In such an electric stapler, the actuator is generally provided with a pair of switching members which are arranged in the direction of width of a sheet stack at a predetermined distance and are pushed inward by an edge of a sheet stack when the sheet stack is inserted into throat. The switching members actuate the stapling mechanism when they are moved to a predetermined position, whereby a predetermined position of the sheet stack is stapled in parallel stapling. When a corner of a sheet stack is inserted into the throat of such a stapler for slantwise stapling, the corner of the sheet stack is inserted between the switching members and the edges of the sheet stack forming the corner are brought into contact with the switching members and push the switching members inward. In this case, when a predetermined position of the sheet stack in the corner in which the sheet stack is to be stapled is brought to the stapling mechanism, the switching members are still short of said predetermined position where they actuate the stapling mechanism and accordingly the stapling mechanism cannot be actuated. The stapling mechanism can be actuated if the sheet stack is further inserted into the throat. However this results in slantwise stapling in a portion remote from the predetermined position of the sheet stack in the corner.

If a manual switch or the like for actuating the stapling mechanism is separately provided and the manual switch is operated to actuate the stapling mechanism when a corner of a sheet stack is inserted into the throat by a certain amount, the stapled position of the sheet stack will vary from sheet stack to sheet stack though the sheet stacks can be stapled in slantwise stapling.

Accordingly, conventionally a slantwise stapling adapter is employed when effecting slantwise stapling in such a stapler. However the adapter must be removed from the stapler when parallel stapling is to be effected, which can result in the loss of the adapter.

SUMMARY OF THE INVENTION

In view of the foregoing observations and description, the primary object of the present invention is to provide an electric stapler which can be easily switched from parallel stapling to slantwise stapling and from the latter to the former.

In accordance with the present invention, there is provided an electric stapler comprising a stapling mechanism which is connected to a power source through a switch and staples a sheet stack inserted into a throat and an actuator which is adapted to abut against an edge of a sheet stack at a plurality of positions along the edge of the sheet stack and to be moved by the sheet stack in response to insertion thereof to an operative position where it operates the switch to actuate the stapling mechanism, wherein the improvement comprises a sub-actuator which is positioned in front of the actuator and is movable between an erected position where it stands into the sheet stack insertion passage to abut against a sheet stack when the sheet stack is inserted into the throat and a horizontal position where it is retracted from the sheet stack insertion passage not to abut against a sheet stack, the sub-actuator being adapted to abut against a pair of adjacent edges of a sheet stack forming a corner of the sheet stack when it is in the erected position and being movable to drive the actuator to said operative position pushed by the sheet stack as the sheet stack is further inserted into the throat.

It is preferred that the sub-actuator be urged forward by a spring member and be moved to drive the actuator to said operative position overcoming the force of the spring member.

The electric stapler of the present invention can be easily switched from parallel stapling to slantwise stapling and from the latter to the former by only erecting or flattening the sub-actuator. Further since the sub-actuator need not be removed from the stapler, there is no fear of loss of the sub-actuator unlike the conventional adapter.

Further since the switch is operated by way of the actuator both in parallel stapling and in slantwise stapling, the control system may be simple in structure.

DESCRIPTION OF THE PREFERRED EMBODIMENT

Figure 1:
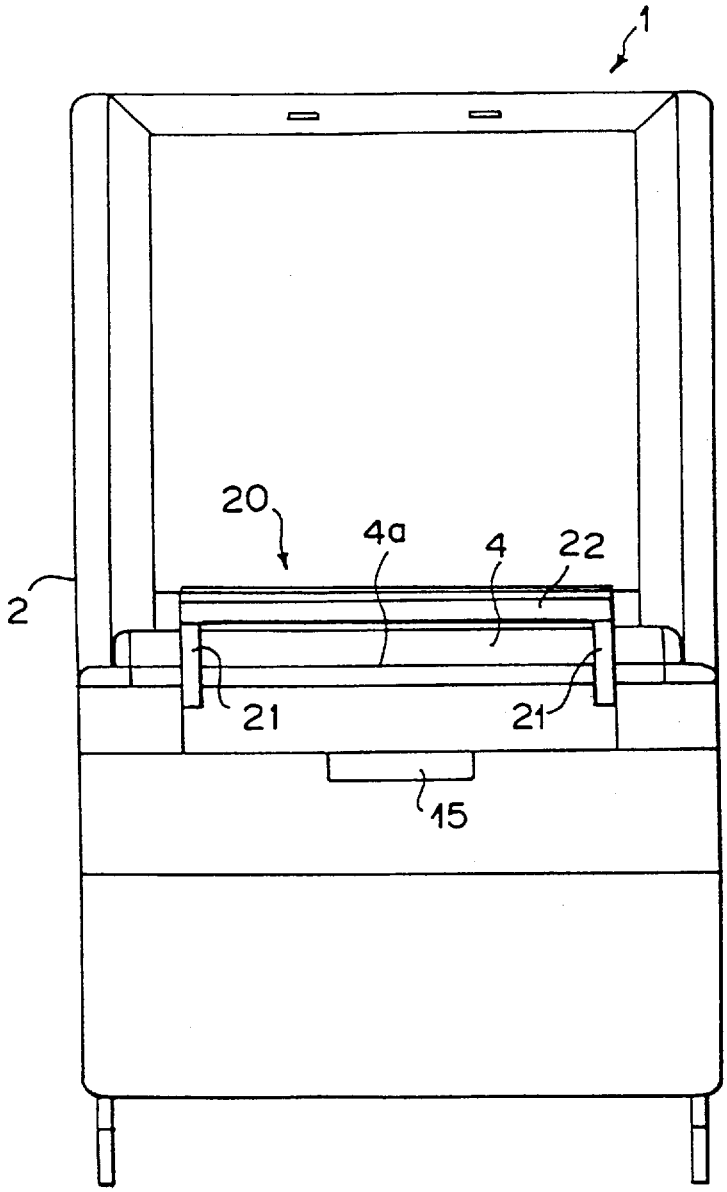
FIG. 1 is a front view of an electric stapler in accordance with an embodiment of the present invention with the sub-actuator in the erected position.

An electric stapler in accordance with the present invention will be described with reference to FIGS. 1 to 4, hereinbelow. The stapler of this embodiment is mounted, for instance, on the outer wall of a sheet sorter which is provided with a plurality of bins each of which receives a plurality of sheets discharged from an image recording apparatus such as a printer, a copier or the like and forms thereon a stack of sheets.

In FIGS. 1 to 4, the stapler 1 has a throat 4 into which a sheet stack 3 to be stapled is inserted. The throat 4 opens in the front face of a body frame 2 and extends from one side face of the body frame 2 to the other. The lower side of the throat 4 is defined by a flat surface 4*a* and the sheet stack 3 is rested on the surface 4*a*. The surface 4*a* will be referred to as the "sheet rest surface 4*a* ", hereinbelow. There is disposed in the back of the throat 4 a stapling portion 5 at which a stapling mechanism operates to staple the sheet stack 3. Since the stapling mechanism is of a known structure and its structure is not directly related to the present invention, the stapling mechanism will not be described nor shown here. A pair of slots 6 are formed on opposite sides of the stapling portion 5 to extend in the direction of insertion of the sheet stack 3 (from right to left in FIGS. 2 and 4). A pair of levers 7 project upward beyond the sheet rest surface 4*a* from the respective slots 6.

Figure 4:
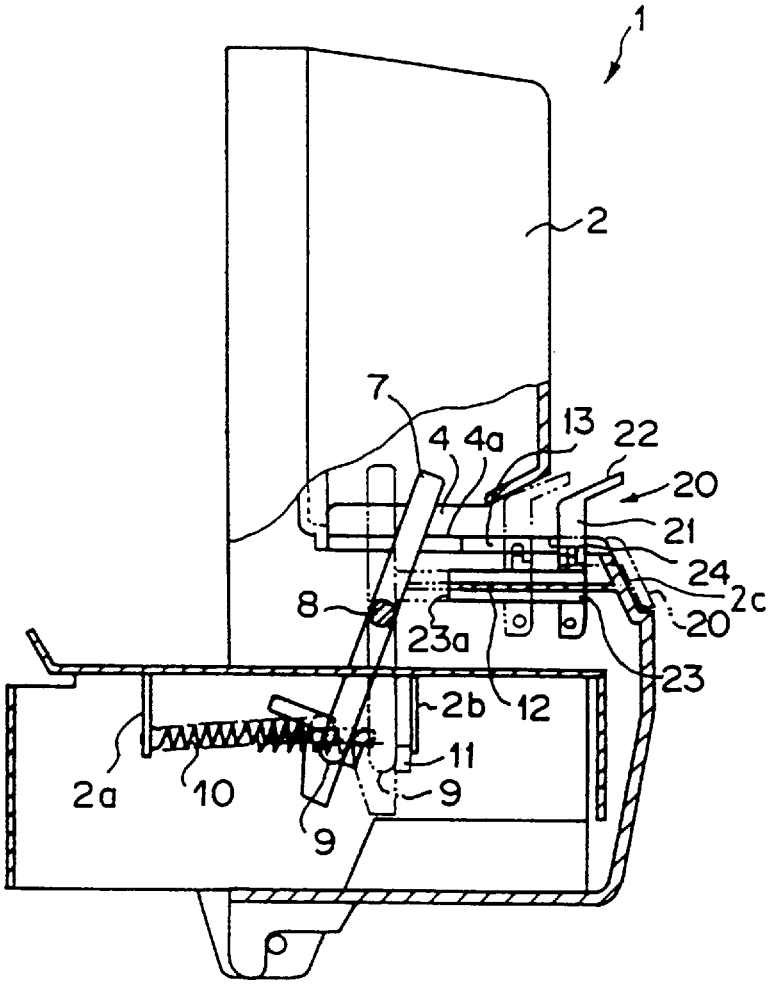
FIG. 4 is a vertical cross-sectional view of the stapler with the sub-actuator in the erected position.

The levers 7 are supported for rotation on a shaft 8 which extends normal to the direction of insertion of the sheet stack 3, and the lower end portions of the respective levers 7 are connected by a connecting member 9 extending in parallel to the shaft 8. The levers 7 are urged in the clockwise direction as seen in FIG. 4 so that the upper ends thereof are directed forward by a coiled spring 10 connected to the connecting member 9 at its one end and to an engagement piece 2*a* on the body frame 2. The levers 7 are held in the position shown by the solid line in FIG. 4 with their side edges in abutment against the forward edges of the respective slots 6.

A switch 11 for energizing the stapling mechanism is mounted on a mount 2*b* in the body frame 2. When the levers 7 are rotated in the counterclockwise direction in FIG. 4 to a predetermined position, one of the levers 7 or the connecting member 9 acts on the switch 11 and the switch 11 is turned on to energize the stapling mechanism. That is, the levers 7 function as an actuator for actuating the stapling mechanism.

Figure 2:
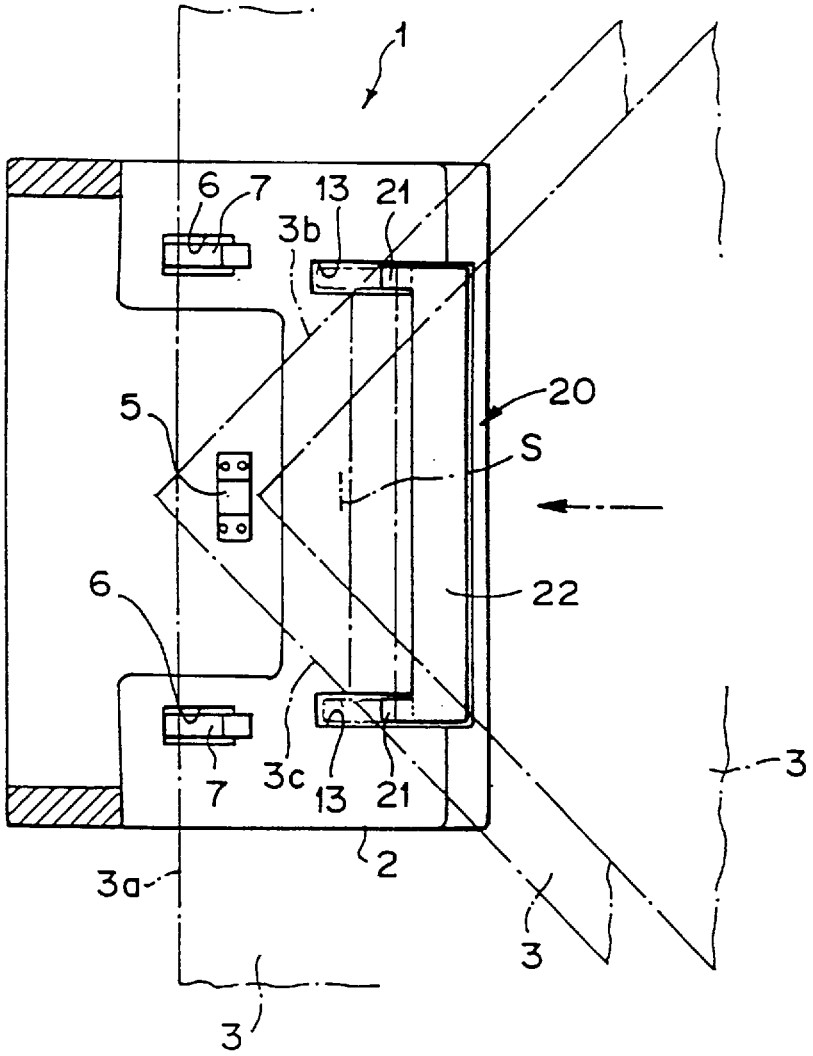
FIG. 2 is a plan view showing the bottom of the throat of the stapler with the sub-actuator in the erected position.
Figure 3:
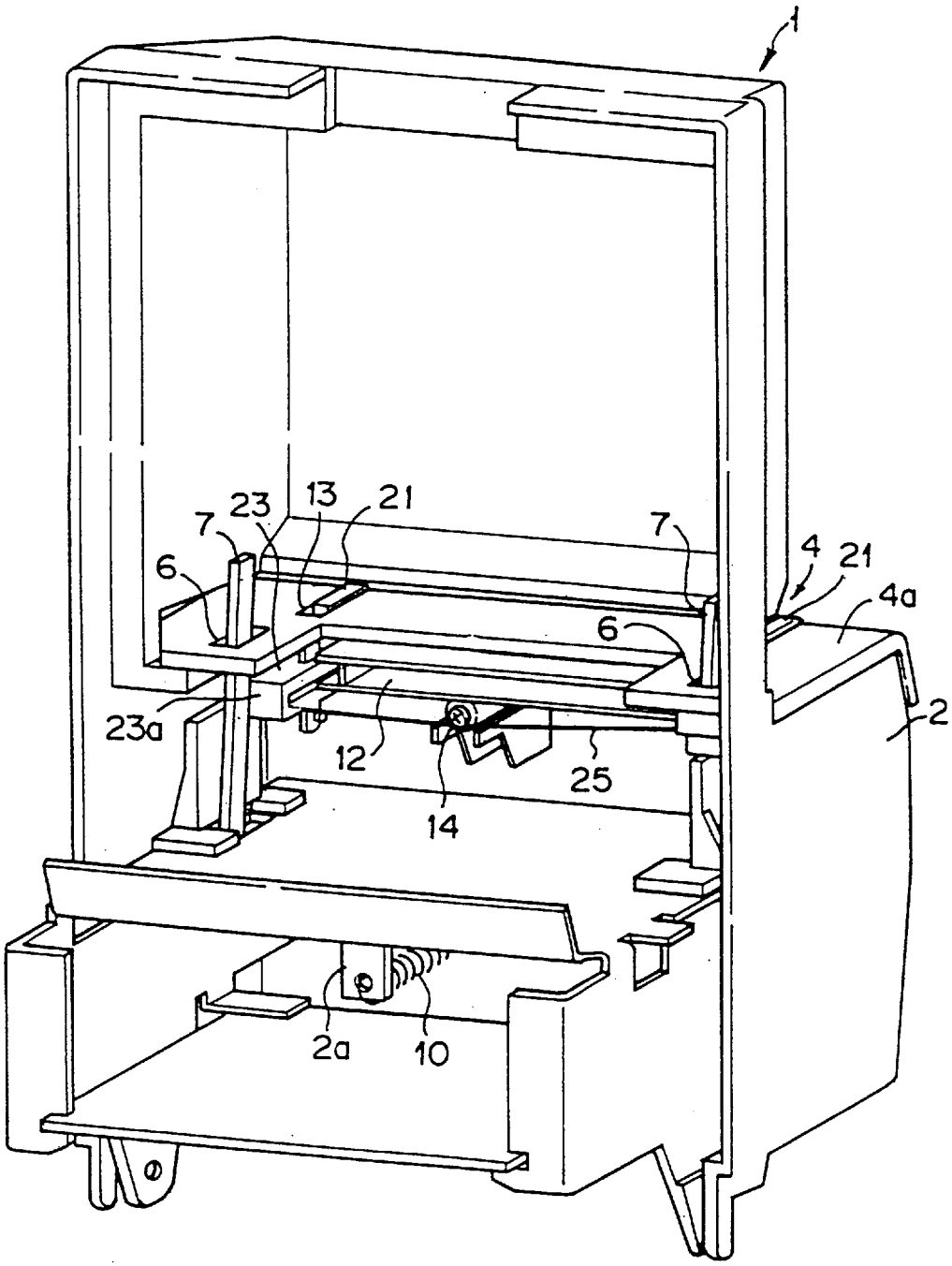
FIG. 3 is a rear view in perspective of the stapler with the sub-actuator in the horizontal position.

A sub-actuator 20 for slantwise stapling is provided near the entrance to the throat 4 to be movable between an erected position shown in FIGS. 1, 2 and 4 and a horizontal position shown in FIG. 3. The sub-actuator 20 comprises a pair of levers 21 respectively extending through a pair of slots 13 which are formed in front of the actuator levers 7 to extend in the direction of insertion of the sheet stack 3 and are spaced from each other in a direction normal to the direction of insertion of the sheet stack 3, and a connecting bar 22 which is in the form of an elongated flat plate and connects the upper end portions of the respective levers 21. The connecting bar 22 is inclined downward at a predetermined angle toward the back of the throat 4 as shown in FIG. 4.

A pair of sliding members 23 are disposed below the slots 13 to be slidable left and right in FIG. 4 on a horizontal guide plate 12 provided in the body frame 2. The sliding members 23 are urged rightward as seen in FIG. 4 by a linear spring member 25 fixed to the body frame 2 by a screw 14 at the middle thereof as shown in FIG. 3.

The lower ends of the levers 21 of the sub-actuator 20 are mounted on the front end portions of the respective sliding members 23 to be rotatable through about 90° about pivot pins 24 normal to the direction of insertion of the sheet stack 3. The sub-actuator 20 is selectively held in the erected position shown by the solid line in FIG. 4 where the levers 21 are erected or the horizontal position shown by the chained line in FIG. 4 where the levers 21 are flattened by a suitable click stop mechanism.

Irrespective of whether levers 21 are erected or flattened, the sub-actuator 20 is normally held in the position shown by the solid line in FIG. 4 by the spring member 25 which urges rightward the sliding members 23.

The sub-actuator 20 is rotated through about 90° between the erected position and the horizontal position with the connecting bar 22 held by the operator's fingers. In order to facilitate holding the connecting bar 22 when the sub-actuator 20 is in the horizontal position, a recess 15 is formed on the front face of the body frame 2 to extend along the lower edge of the connecting bar 22.

As shown in FIGS. 3 and 4, when the sub-actuator 20 in the horizontal position, the levers 21 are substantially flush with the sheet rest surface 4*a*, and the connecting bar 22, which is inclined as described above, is in close contact with an inclined surface 2*c* of the body frame 2 which is inclined downward from the front edge of the sheet rest surface 4*a* at the entrance of the throat 4. Thus, in the horizontal position, the sub-actuator 20 does not interfere with a sheet stack 3 which is inserted into the throat for parallel stapling.

When parallel stapling is to be effected on a sheet stack 3 at a portion near a side edge 3*a* (FIG. 2) thereof, the sub-actuator 20 is held in the horizontal position and the side edge 3*a* of the sheet stack 3 is inserted into the throat 4 of the stapler 1 by moving the sheet stack 3 in the direction normal to the side edge 3*a* as shown in FIG. 2. As the sheet stack 3 is moved toward the back of the throat 4, the levers 7 are brought into abutment against the side edge 3*a* of the sheet stack 3 and rotated in the counterclockwise direction as seen in FIG. 4 pushed by the sheet stack 3, thereby permitting the side edge 3*a* to be inserted beyond the stapling portion 5, while guiding the sheet stack 3 not to get inclined. When the levers 7 are rotated to a predetermined position, the switch 11 is turned on and the stapling mechanism is actuated to staple the side edge portion near the side edge 3*a* in parallel to the side edge 3*a*.

When slantwise stapling is to be effected, the sub-actuator 20 is erected. When a corner of a sheet stack 3 is inserted into the throat 4 with the sub-actuator 20 erected, the levers 21 are brought into abut against the edges 3*b* and 3*c* (FIG. 2) of the sheet stack 3 forming the corner, and as the sheet stack 3 is further inserted into the throat 4, the levers 21 are pushed leftward by the sheet stack 3 along the slots 13 overcoming the force of the spring member 25 while guiding the sheet stack 3. As the levers 21 are moved leftward, the sliding members 23 are also moved leftward and rear end faces 23*a* of the sliding members 23 are brought into abutment against the levers 7, whereby the levers 7 are rotated to turn on the switch 11 and the stapling mechanism is actuated to staple diagonally the corner of the sheet stack 3 as shown by the chained line S in FIG. 2.

As can be understood from the description above, the electric stapler 1 of this embodiment can be easily switched from parallel stapling to slantwise stapling and from the latter to the former by only rotating the sub-actuator 20. Further since the sub-actuator 20 need not be removed from the stapler 1, there is no fear of loss of the sub-actuator 20 unlike the conventional adapter.

Further since the switch 11 is operated by way of the levers 7 both in parallel stapling and in slantwise stapling, the control system is not complicated.

Though, in the embodiment described above, one of the levers 7 or the connecting member 9 acts on the switch 11 to actuate the stapling mechanism, a photoelectric sensor or the like which detects the position of the levers 7 may be employed to actuate the stapling mechanism.

What is claimed is:

1. An electric stapler comprising a stapling mechanism which is connected to a power source through a switch and staples a sheet stack inserted into a throat and an actuator which is adapted to abut against an edge of a sheet stack at a plurality of positions along the edge of the sheet stack and to be moved by the sheet stack in response to insertion thereof to an operative position where the actuator operates the switch to actuate the stapling mechanism, wherein the improvement comprises a sub-actuator which is positioned in front of the actuator and is movable between an erected position where the sub-actuator stands into the sheet stack insertion passage to abut against a sheet stack when the sheet stack is inserted into the throat and a horizontal position where the sub-actuator is retracted from the sheet stack insertion passage not to abut against a sheet stack, the sub-actuator being adapted to abut against a pair of adjacent edges of a sheet stack forming a corner of the sheet stack when the sub-actuator is in the erected position and being movable to drive the actuator to said operative position pushed by the sheet stack as the sheet stack is further inserted into the throat.

2. An electric stapler as defined in claim 1 in which the sub-actuator is urged forward by a spring member and is moved to drive the actuator to said operative position overcoming the force of the spring member.

* * * * *